United States Patent [19]

Garnsworthy

[11] Patent Number: 4,577,458

[45] Date of Patent: Mar. 25, 1986

[54] JOINING OF YARNS BY PNEUMATIC SPLICING

[75] Inventor: Russell K. Garnsworthy, Highton, Australia

[73] Assignee: Commonwealth Scientific and Industrial Research Organization, Australia

[21] Appl. No.: 660,674

[22] Filed: Oct. 15, 1984

[30] Foreign Application Priority Data

Oct. 14, 1983 [AU] Australia ..... PG1861

[51] Int. Cl.[4] ..... B65H 69/06; D01H 15/00

[52] U.S. Cl. ..... 57/22

[58] Field of Search ..... 57/22, 23, 261, 263, 57/350, 908

[56] References Cited

U.S. PATENT DOCUMENTS 3,474,615 10/1969 Irwin et al. ..... 57/22 X
4,356,688 11/1982 Zurcher et al. ..... 57/22
4,428,992 1/1984 Street ..... 57/22 X

*Primary Examiner*—Donald Watkins
*Attorney, Agent, or Firm*—Sughrue, Mion, Zinn, Macpeak, and Seas

[57] ABSTRACT

Apparatus for splicing fibrous yarns includes structure having walls which define a chamber accessible to receive respective portions of the yarns and confine them adjacent one another. A gas stream may be directed into the chamber transversely to the yarn portions. Means is provided to maintain the gas stream entering the chamber, and preferably also the walls of the chamber, at an elevated temperature sufficient to produce an enhanced intermingling of fibres of the yarn portions which is effective to splice the yarns together. Also disclosed is the corresponding method of splicing fibrous yarns.

20 Claims, 4 Drawing Figures

JOINING OF YARNS BY PNEUMATIC SPLICING

Figure 1:
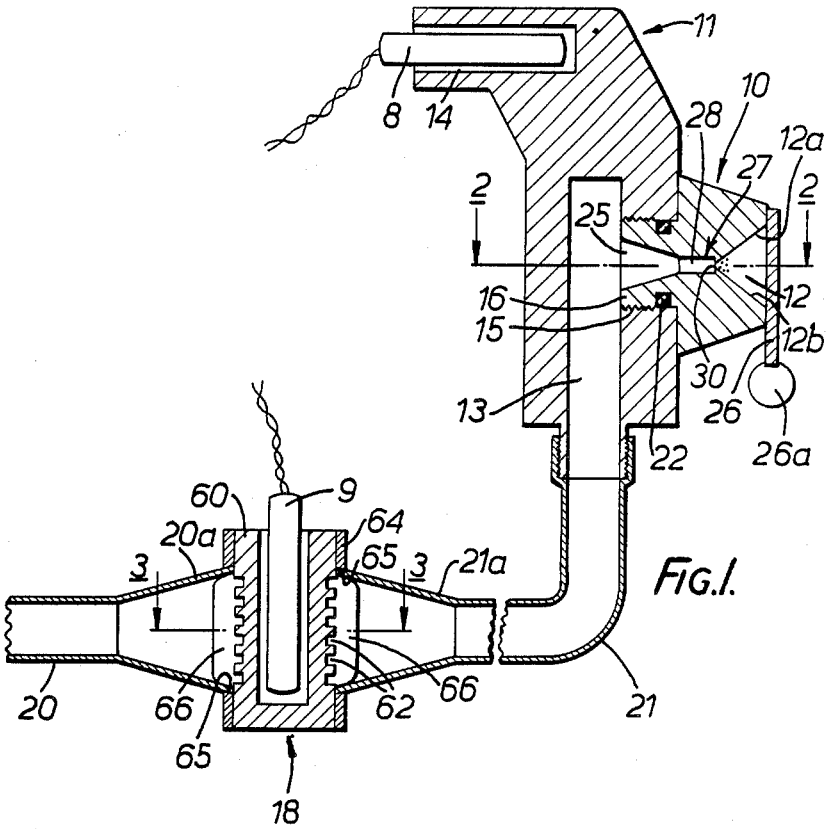

This invention relates to the joining of twisted fibrous yarns by splicing. The respective yarns to be joined are often separated portions of a broken yarn.

The common method of restoring broken textile yarns is to apply a knot. Knots, however, have short comings such as snagging, slipping and parting during ordinary textile processing. Additionally, knots remain visible in the subsequent knitted, woven or tufted article and the practice is for skilled personnel to inspect the article and to mend out the knots by hand. Such practice renders the knotting process especially labour intensive. Earlier attempted substitutes for knotting, e.g. glueing, welding and wrapping, have not been viewed as satisfactory because they are difficult techniques to administer and the resultant joints represent significant discontinuities in the yarns.

More recently, a practice has developed of splicing twisted staple yarns pneumatically. Commercial pneumatic splicers have been produced, and are characterized by the application of high pressure air jets transversely to the overlaid ends of the yarns to be spliced, or of the broken yarn, for a brief but accurately controlled interval of time, so as to cause the fibres at the respective ends to interact by being intermingled and twisted together. Although success has been achieved in producing substantially undetectable joints, it is found in practice, firstly, that the strength of the spliced yarn is somewhat variable, and, secondly, that a substantial proportion of splicing attempts are wholly unsuccessful, often because the yarn ends are blown out of the chamber. These limitations are accepted in some plants because of the relative simplicity of the method and because those splices which are made do not require subsequent mending out.

A further difficulty with pneumatic splicers is that an inability to untwist and open the ends of highly twisted yarns can limit the range of their applicability. They have also proven unsuitable for splicing heavy yarns such as carpet yarns, which are still usually joined with latex glue.

One form of pneumatic splicer is disclosed in United Kingdom Patent Specification No. 2,018,846. In this case the air jet, and the proximate yarn ends, are cycled rapidly between two outlets in communication with respective air and yarn inlets. One such arrangement effects the cycling by periodic closure of one outlet in alignment with the air inlet.

In accordance with the present invention, it has been surprisingly found that the reliability of pneumatic splicing and the average strength of splices can be substantially improved by heating the gas stream, typically an air jet, entering the splicing chamber, and preferably also the walls of the chamber.

The invention accordingly provides, in one aspect, a method of splicing fibrous yarns comprising directing a gas stream transversely to adjacent portions of the yarns disposed within a chamber, wherein the gas stream entering the chamber is maintained at an elevated temperature sufficient to produce an enhanced intermingling of fibres of the yarn portions which is effective to splice the yarns together.

Preferably, the walls of the chamber and the gas stream entering the chamber are maintained at respective elevated temperatures sufficient to produce an enhanced intermingling of fibres of the yarn portions which is effective to splice the yarn together.

Said elevated temperature(s) is preferably at least 50° C., and in the range 100°-140° C. for most yarns. The upper limit for the temperature, which will vary accordingly to the nature of the fibres, is that temperature at which the heat begins to cause breakdown of fibres or chemical changes in the fibres, and/or to char or singe the fibres, to an extent such that overall splicing reliability and/or strength diminishes rather than improves. In the case of cotton yarns, the elevated temperature(s) is desirably in the range 50° to 100° C.; for wool or synthetic yarns, or yarns comprising a blend of wool and synthetic, the elevated temperature(s) is preferably in the range 100° to 140° C.

The invention also provides apparatus for splicing fibrous yarns comprising structure having walls which define a chamber accessible to receive respective portions of the yarns and confine them adjacent one another, means to direct a gas stream into said chamber transversely to said yarn portions, and means to maintain the gas stream entering the chamber at an elevated temperature sufficient to produce an enhanced intermingling of fibres of the yarn portions which is effective to splice the yarns together.

The means to direct a gas stream into said chamber may include a duct for the stream, and the temperature maintaining means preferably comprises heat exhange means, for example a resistance heater, in the duct.

Advantageously, the temperature maintaining means maintains the chamber walls and the gas stream entering the chamber at respective elevated temperatures sufficient to produce an enhanced intermingling of fibres of the yarn portions which is effective to splice the yarns together. A recess for a heater may be provided in heat conductive contact with the chamber walls.

The splicing chamber is typically a channel with a moveable cover which may be withdrawn to facilitate placement of the yarn portions in the channel and closed prior to admission of the gas stream into the channel. The means to direct the gas stream preferably includes a jet nozzle directed through the floor of and transversely to the channel, the channel being closed opposite the nozzle so that the gas stream is deflected towards respective ends of the channel.

Heating means for the gas stream may be associated with the splicing chamber as an arrangement for applying a suitable electric arc discharge along the stream. The walls of the nozzle may comprise one electrode while the other electrode is provided by a needle, preferably axially moveable, with its tip in the nozzle or adjacent the head of the nozzle.

Figure 2:
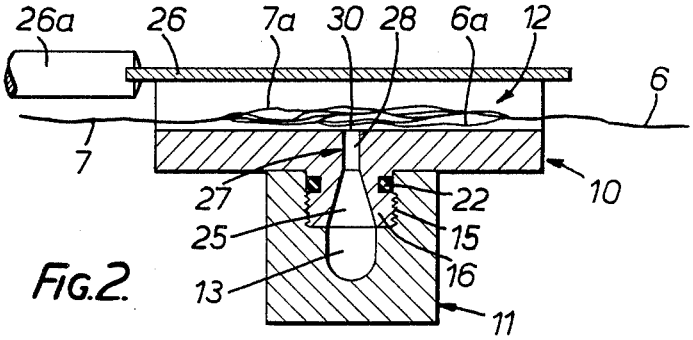
Figure 3:
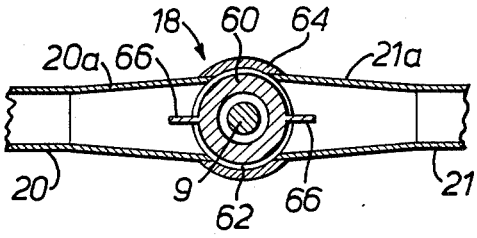
Figure 4:
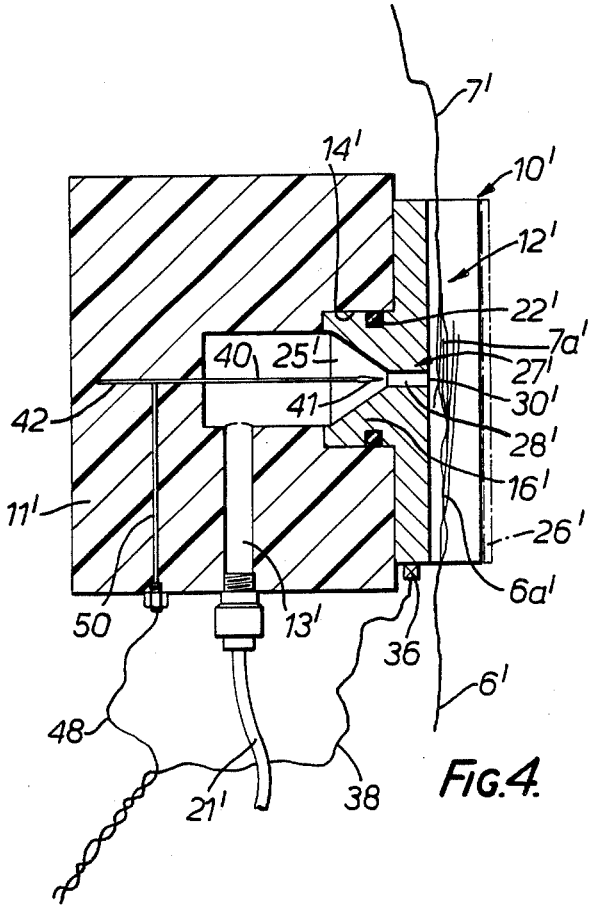

The invention will be further described, by way of example only, with reference to the accompanying drawings, in which:

FIG. 1 is a schematic vertically sectioned view of splicing apparatus in accordance with a first embodiment of the invention, in a form which might readily be adapted to a textile winding frame, FIGS. 2 and 3 are horizontal cross-sections on the lines 2—2 and 3—3 in FIG. 1; and FIG. 4 is a view in a plane similar to FIG. 2 of a second embodiment of the invention utilizing an electric arc discharge to heat the applied air jet, like parts being indicated by like reference numerals.

The illustrated splicing apparatus includes a metallic channel 10 with inclined walls 12*a*, 12*b* defining an elongate splicing chamber 12, a solrd metal body 11 having an air cavity 13 of circular cross-section and a socket 15 for a complementary spigot 16 which projects integrally from the underside of channel 10, a heat exchanger 18, and respective tubular ducts 20, 21 by which air is admitted to the heat exchanger and conveyed, as heated air, to cavity 13. The engagement between socket 15 and spigot 16 is shown as a threaded coupling sealed by an O-ring 22, but may be a press fit or other engagement as appropriate. Socket 15, and therefore the end of spigot 16, are open to cavity 13. An upper portion of body 11 above cavity 13 and socket 15 has a second cavity 14 adapted to receive electrical resistance cartridge heater 8 for heating the walls 12*a*, 12*b* of chamber 12 by way of the heat conductive contact provided by body 11 and channel 10.

Splicing chamber 12 is of V-shaped cross-section with a very narrow floor. In use, chamber 12 is overlaid by a cover comprising a flap 26 hinged on a pin 26*a* rotatable (by means not shown) between a closed position, as illustrated in FIGS. 1 and 2, and an open condition permitting access for facilitating placement of yarn portions 6*a*, 7*a* lengthwise in chamber 12.

Cavity 13 is placed in communication with chamber 12 by means of a convergent recess 25 in the base end of spigot 16, and a nozzle 27 including a short duct 28 and an orifice 30 provided as a slit in the floor of chamber 12.

Heat exchanger 18 comprises a cylindrical heat conductive core 60 having a central cavity for a second electrical resistance cartridge heater 9 and multiple annular grooves 62 in its outer cylindrical surface. An annular casing 64 for the core has a pair of diametrically opposed apertures 65 which sealingly received respective flared end portions 20*a*, 21*a* of ducts 20, 21. Atmospheric air forced along duct 20 by a suitable blower (not shown) is heated as it traverses grooves 62. The heated air continues along duct 21 to cavity 13 and is then forced as a jet into chamber 12 via nozzle 27. Baffles 66 (best seen in FIG. 3) help minimise turbulence in the flow.

To operate the illustrated apparatus as a conventional pneumatic splicer, cover 26 is retracted, and portions 6*a*, 7*a* of staple yarns 6, 7 to be spliced (which may be the ends of a broken yarn) are laid in chamber 12 over and/or adjacent orifice 30. On a textile winding or spinning frame, movement of cover 26 and laying of the yarn portions would commonly be carried out mechanically using an arrangement of grips, cams and the like (not shown). The respective yarn portions laid in chamber 12 will typically contain loosened fibres which may be partly untwisted to form beards. Cover 26 is replaced and pressurised air at ambient temperature is jetted through nozzle 27 for a brief but accurately controlled interval of time, e.g. 0.1 sec, and thereby applied to chamber 12 transversely with respect to the chamber and yarn portions 6*a*, 7*a* to intermingle the fibres of the yarn portions and thereby splice the yarns. The air stream is deflected by cover 26 to respective ends of the chamber.

In accordance with a preferred application of the invention, the intermingling of the fibres is enhanced, as evidenced by material improvement in both the reliability factor and the strength of the splice, by heating the walls of the splicing chamber and the stream or pulse of air entering the chamber. Heat exchanger 18 and cavity 14 are provided for this purpose, and the actual heat source in operation comprises the removable cartridge heaters 8, 9.

The walls 12*a*, 12*b* of the chamber and the air stream entering the chamber at orifice 30 are preferably maintained at respective elevated temperatures of at least 50° C. The most favourable temperature range will vary according to the nature of the fibres: the upper limit is that temperature at which the heat begins to cause breakdown of fibres or chemical changes in the fibres, and/or to char or singe the fibres, to an extent such that overall splicing reliability and/or strength diminishes rather than improves. For wool fibres, optimum enhancement is obtained for a temperature above 100° C. but it is believed that the temperature should not exceed 140° C. In the case of cotton, the preferred range is 50° to 100° C. It will be understood that the temperatures of the chamber walls and air stream may be substantially equal but that such is by no means necessary or even practicable.

With the illustrated heat exchanger, it is found that to achieve an air stream temperature of 120° C. at orifice 30, core 60 must be maintained at about 250° C. For this reason, it is preferred that heat exchanger 18 be displaced some distance from block 11.

It is known that the application of a suitable electric arc discharge along a gas stream will cause substantial heating of the stream. This principle is applied in a second embodiment, depicted in FIG. 4, wherein provision is made to apply an electric arc discharge across the air stream jetted into the splicing chamber to heat the stream, and perhaps to a limited extent the walls of the splicing chamber. This embodiment includes a support block 11', in this case of electrically insulating material, a metallic channel 10', of similar construction to channel 10 in FIGS. 1 and 2, defining an elongate splicing chamber 12', and a cylindrical air cavity 13' within block 11'. Cavity 13' opens in the front face of block 11' and is counterbored to form a socket 14' for a complementary spigot 16' which integrally projects from the underside of channel 10'.

For applying the arc, channel 10', which as mentioned is metallic, is rendered the neutral electrode for the discharge by earthing it from a terminal 36 via an electrical lead 38. The live electrode comprises a needle 40 co-axially mounted in cavity 13' by being embedded at 42 in insulated block 11'. An external electrical lead 48 is coupled to needle 40 by a laterally extending conductor 50 in the support block. The tip 41 of the needle 40 is positioned as illustrated at the head of duct 28'.

In a typical installation, duct 28' has an internal diameter of about 2 mm. By applying about 2 KV at, say, 50 Hz across the supply leads 38, 48, an electric arc discharge is developed between the tip 41 of needle 40 and the adjacent surfaces of channel 10'. This discharge generates a high temperature plasma of ionized air molecules in the air jet in the region of duct 28' and raises the localized temperature of the jet in the duct 28' to about 800° C. It is preferable that the arc be broadly parallel to the air jet to guard against destruction of the arc by the high velocity air.

Part of the splicing assistance afforded by the arc may be due to surface modification of the fibres by the plasma to enhance their frictional engagement.

It is found that if the pneumatic splicing process is carried out in accordance with the invention there is a marked and sustained improvement in the reliability of the splice, whether the yarn ends were first opened out to form beards or left as broken/cut ends. In particular, it is observed that the proportion of blown-out ends is very much reduced and it is found possible to apply the air pulse or stream for longer than was previously considered to be the maximum for a tolerable reliability factor. Indeed, relative to prior techniques it is possible to have greater variations in the duration of the air pulse, for example within the range 0.25 to 0.50 seconds, and in the pressure of the pulse. The longer splicing time, and the splicing method per se, are both thought to contribute to the observed increase in the mean strength of the splices. Applicant believes that this improvement may possibly be obtained because the heated environment softens the fibres and reduces their rigidity. This directly improves the ability of the fibres to intermingle and twist about each other, and also allows the beards to open up better than before, so further enhancing intertwining as well as opposing blow out of the ends from the splicing chamber. The higher velocity of the air emerging from orifice 30 at higher temperatures may also be a contributing factor in the enhancement.

Pneumatic splicing according to the invention is found to be successful in splicing heavy yarns such as carpet yarns, which, as mentioned, are presently glued together.

It will be understood that the invention is in no way limited to the particular details described or illustrated. In particular, the cross-sectional shape of chamber 12, the number of ducts 28 and orifices 30, and the precise physical relationship between chamber 12, duct 28 and orifice 30 are not believed to have a material bearing on the performance of the inventive modification of the conventional splicing process. There has been much published literature and research regarding these aspects of pneumatic splicing. Moreover, the precise means of heating is not important, and with the electric arc technique it would appear that the precise position of the needle tip is not crucial, although it ought of course to be close to duct 28 in order to have a sufficiently small gap for the discharge. In a practical embodiment, needle 40 may well be rendered axially moveable so that the position of the tip, and therefore of the arc, might be varied for different environments, channel configurations or types of yarn.

I claim:

1. Apparatus for splicing fibrous yarns comprising structure having walls which define a chamber accessible to receive respective portions of the yarns and confine them adjacent one another, means to direct a gas stream into said chamber transversely to said yarn portions, and means to maintain the gas stream entering the chamber at an elevated temperature sufficient to produce an enhanced intermingling of fibres of the yarn portions which is effective to splice the yarns together.

2. Apparatus according to claim 1 wherein said means to direct a gas stream into said chamber includes a duct for the stream, and wherein said temperature maintaining means comprises heat exchange means in the duct.

3. Apparatus according to claim 1 wherein the temperature maintaining means maintains the chamber walls and the gas stream entering the chamber at respective elevated temperatures sufficient to produce an enhanced intermingling of fibres of the yarn portions which is effective to splice the yarns together.

4. Apparatus according to claim 3 wherein said means to direct a gas stream into said chamber includes a duct for the stream, and wherein said temperature maintaining means comprises heat exchange means in the duct and a recess for a heater in heat conductive contact with the walls.

5. Apparatus according to claim 3 wherein the temperature maintaining means includes one or more electrical resistance heaters.

6. Apparatus according to claim 3 wherein the chamber is a channel with a movable cover which may be withdrawn to facilitate placement of the yarn portions in the channel and closed prior to admission of the gas stream into the channel.

7. Apparatus according to claim 6 wherein the means to direct a gas stream includes a jet nozzle directed through the floor of and transversely of the channel, the channel being closed opposite the nozzle so that the gas stream is deflected towards respective ends of the channel.

8. Apparatus according to claim 1 wherein the temperature maintaining means includes one or more electrical resistance heaters.

9. Apparatus according to claim 1 wherein the chamber is a channel with a movable cover which may be withdrawn to facilitate placement of the yarn portions in the channel and closed prior to admission of the gas stream into the channel.

10. Apparatus according to claim 9 wherein the means to direct a gas stream includes a jet nozzle directed through the floor of and transversely of the channel, the channel being closed opposite the nozzle so that the gas stream is deflected towards respective ends of the channel.

11. A method of splicing fibrous yarns comprising directing a gas stream transversely to adjacent portions of the yarns disposed within a chamber, wherein the gas stream entering the chamber is maintained at an elevated temperature sufficient to produce an enhanced intermingling of fibres of the yarn portions which is effective to splice the yarn together.

12. A method according to claim 8 wherein the walls of the chamber and the gas stream entering the chamber are maintained at respective elevated temperatures(s) sufficient to produce an enhanced intermingling of fibres of the yarn portions which is effective to splice the yarn together.

13. A method according to claim 12 wherein the elevated temperatures are at least 50° C.

14. A method according to claim 12 wherein the yarns include cotton and said elevated temperatures are in the range 50° to 100° C.

15. A method according to claim 12 wherein the yarns are wool or synthetic yarns, or yarns comprising a blend of wool and synthetic, and said elevated temperatures are in the range 100° to 140° C.

16. A method according to claim 12 wherein the chamber is elongate and said gas stream is directed through the floor of and transversely of the chamber, being deflected by an opposed wall portion to respective ends of the chamber.

17. A method according to claim 11 wherein the elevated temperature is at least 50° C.

18. A method according to claim 11 wherein the yarns include cotton and said elevated temperature is in the range 50° to 100° C.

19. A method according to claim 11 wherein the yarns are wool or synthetic yarns, or yarns comprising a blend of wool and synthetic, and said elevated temperature is in the range 100° to 140° C.

20. A method according to claim 11 wherein the yarns are wool or synthetic yarns, or yarns comprising a blend of wool and synthetic, and said elevated temperature is in the range 100° to 140° C.

* * * * *